US006474640B1

(12) United States Patent
Bunch, III

(10) Patent No.: US 6,474,640 B1
(45) Date of Patent: Nov. 5, 2002

(54) METHOD AND APPARATUS FOR STACKING SHEETS IN OFFSET RELATIONSHIP

(76) Inventor: Earnest B. Bunch, III, 3625 N. 50th St., Cave Creek, AZ (US) 85331

( * ) Notice: Subject to any disclaimer, the term of this patent is extended or adjusted under 35 U.S.C. 154(b) by 125 days.

(21) Appl. No.: 09/699,094

(22) Filed: Oct. 27, 2000

(51) Int. Cl.[7] ..... B65H 20/00
(52) U.S. Cl. ..... 271/286
(58) Field of Search ..... 271/285–286, 271/215, 217, 198, 220, 224, 245; 399/404; 414/791.2; 270/58.11, 58.13

(56) References Cited

U.S. PATENT DOCUMENTS 4,318,539 A * 3/1982 Lamos ..... 270/58.3
4,616,821 A * 10/1986 Boeve et al. ..... 271/213
5,020,784 A * 6/1991 Asami et al. ..... 270/58.11
5,366,212 A * 11/1994 Crowley et al. ..... 198/418.8
6,209,865 B1 * 4/2001 Regimbal et al. ..... 271/220
6,241,234 B1 * 6/2001 Saitoh et al. ..... 270/58.12

* cited by examiner

*Primary Examiner*—Donald P. Walsh
*Assistant Examiner*—Kenneth W Bower
(74) *Attorney, Agent, or Firm*—Tod R. Nissle P.C.

(57) ABSTRACT

A method and apparatus forms stacks of paper sheets. Each stack is offset from adjacent stacks. The method and apparatus prevent the top sheet of a first stack of paper from being frictionally dragged out of position when the initial sheet of paper in a second stack slides over the top sheet of the first stack. The method and apparatus clamp the forward edge of the top sheet in the first stack to hold the top sheet in position when the initial sheet of paper in the second stack slides over the top sheet.

2 Claims, 1 Drawing Sheet

METHOD AND APPARATUS FOR STACKING SHEETS IN OFFSET RELATIONSHIP

BACKGROUND OF THE INVENTION

This invention pertains to a method and apparatus for stacking sheets of paper or another material.

More particularly, this invention pertains to a method and apparatus which prevents the top sheet of a stack of paper from being dragged out of position when the first sheet of paper in a second stack slides over the top sheet.

Stacking apparatus for forming offset stacks of paper is well known. Each stack comprises a plurality of equal sized sheets stacked in registration one on top of the other. A conveyor belt delivers sheets for stacking. After the apparatus forms one stack of sheets against a paper stop, the paper stop is displaced and a second paper stop is moved into position. The second paper stop is offset from the first paper stop. A second stack of sheets forms against the second paper stop. The second stack is offset from the first stack. The back of each stack is defined as the portion of each stack that is near the conveyor belt which delivers the sheets which form and comprise the stack. The front of each stack is defined as the portion of each stack that is adjacent the paper stop or stops which halt the travel of each sheet in the stack after the sheet is "thrown" or slid by the conveyor onto the stack.

One problem which is encountered in conventional stacking apparatus is that the initial sheet in the second stack of sheets slides over the top sheet in the first stack of sheets. When the initial sheet slides over the top sheet of the first stack, the initial sheet tends to drag frictionally the top sheet out of registration with the remaining sheets in the first stack. A typical solution for this problem is to include in the stacking apparatus a system for grabbing and holding the back of the first stack while the initial sheet in the second stack slides over the top of the first stack. This solution is dependent on the back of the stack being in a certain position to within a relatively small tolerance. As a result, attempting to prevent the displacement of the top sheet of the first stack by holding the back of the first stack is not always reliable.

Accordingly, it would be highly desirable to provide an improved method and apparatus for preventing the top sheet in a stack of sheets from being frictionally displaced by a sheet that slides over the top sheet.

OBJECTS OF THE INVENTION

Therefore, it is a principal object of the instant invention to provide an improved method and apparatus for stacking sheets of paper or other material in offset relationship.

Another object of the invention is to provide an improved method and apparatus for stacking a second stack of registered sheets on a first stack of registered sheets so that the sheets in the second stack do not cause sheets in the first stack to move out of registration with other sheets in the first stack.

SUMMARY OF THE INVENTION

Briefly, in accordance with the invention, I provide an improved apparatus for stacking sheets in offset stacks. The apparatus includes a delivery system for delivering individual sheets; a support surface; a first paper stop; and a second paper stop. The first paper stop stops the movement of sheets delivered by the delivery system and is moveable between at least two operative positions, a first storage position and a second deployed position. In the second deployed position, the paper stop stops sheets delivered by the delivery system to form a first stack of sheets on the support surface. The first stack has a forward position adjacent the first paper stop. The second paper stop has a deployed position for stopping sheets delivered by the delivery system to form a second stack of sheets on the support surface above and offset from the first stack of sheets. The apparatus also includes a system for clamping the forward portion of the first stack when a sheet in the second stack frictionally slides over a sheet in the first stack.

BRIEF DESCRIPTION OF THE DRAWINGS

The foregoing and other, further and more specific objects and advantages of the invention will be apparent from the following detailed description of the invention, taken in conjunction with the drawings, in which.

In another embodiment of the invention, I provide an improved method for stacking sheets. The method includes the steps of forming a first stack of sheets adjacent a first paper stop, the first stack including a forward portion adjacent the first paper stop; clamping the forward portion of the first stack; and, sliding a sheet in a second stack over the first stack.

DETAILED DESCRIPTION OF THE DRAWINGS

Figure 2:
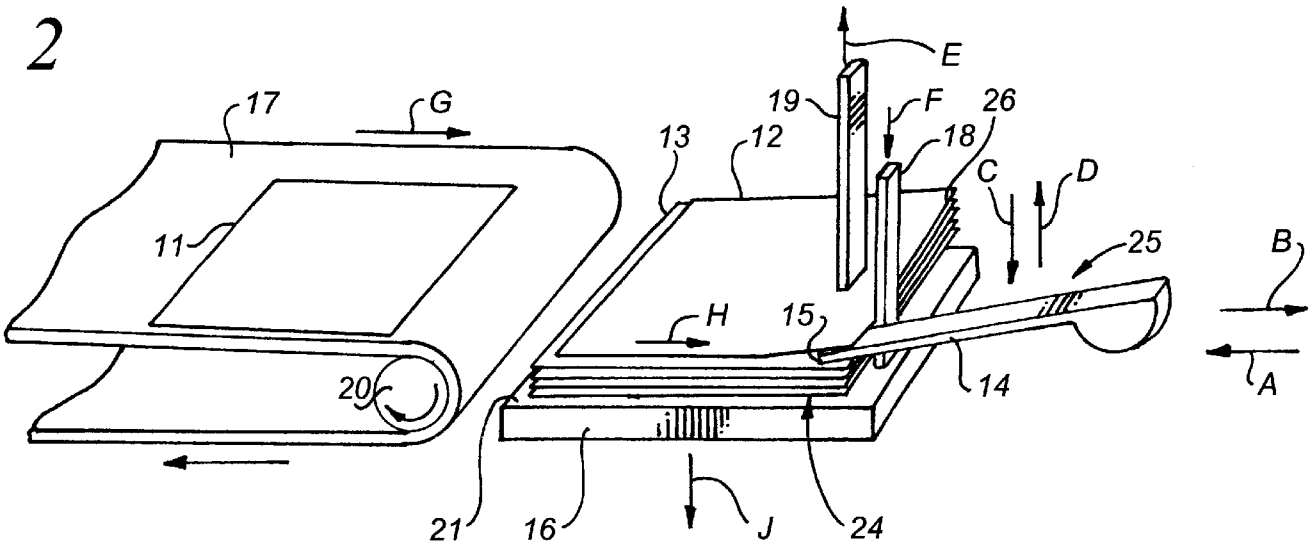
Figure 1:
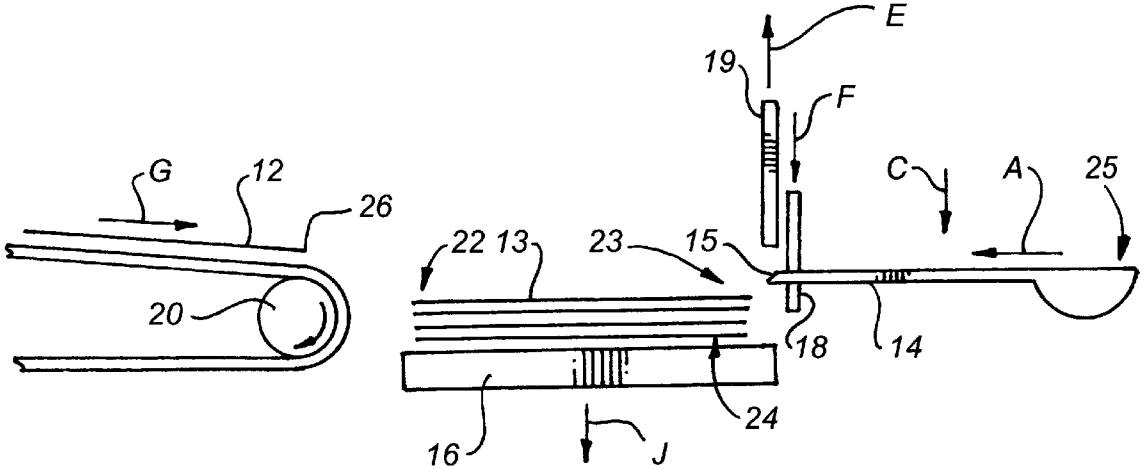
FIG. 1 is a perspective view illustrating stacking apparatus constructed in accordance with the principles of the invention; and, FIG. 2 is a perspective view illustrating the mode of operation of the stacking apparatus of FIG. 1.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 2 illustrate sheet stacking apparatus constructed in accordance with the principles of the invention and including a sheet delivery system comprising a endless conveyor belt 17 which displaces and delivers sheets one-by-one in the direction of arrow G. Driven roller 20 facilitates movement of belt 17. A support surface 21 is provided on top of table 16 to receive and support sheets stacked on table 16. As each stack of sheets is formed on the support surface 21, table 16 is downwardly displaced in the direction of arrow J to provide space for sheets that are directed onto table 16 by conveyor belt 17 either to complete the stack of sheets or to form a new stack of sheets.

In FIGS. 1 and 2, a first stack 24 of four registered sheets has been stacked on support surface 21. The back portion 22 of stack 24 is adjacent belt 17. The front portion 23 of stack 24 is adjacent paper stops 18, 19. Stack 24 includes top sheet 13. When the sheets comprising stack 24 were directed by belt 17 over surface 21 to form stack 24, paper stop 19 was in a position in which stop 19 was downwardly displaced from the position shown in FIGS. 1 and 2 to an elevation comparable to that shown in FIGS. 1 and 2 for paper stop 18 so that as each sheet in stack 24 was "thrown" or delivered over surface 21 by belt 17, the leading edge of each sheet contacted and was stopped by paper stop 19.

In FIG. 1, the top sheet 13 has been delivered. When sheet 13 was delivered in the direction of arrow G by conveyor belt 17, the leading edge of sheet 13 contacted stop 19 and stop 19 halted the travel of sheet 13. Immediately after sheet 13 was delivered to the position shown in FIG. 1, paper stop 19 was displaced upwardly in the direction of arrow E to the position shown in FIG. 1 (and FIG. 2), paper stop 18 was displaced downwardly in the direction of arrow F to the position shown in FIG. 1 (and FIG. 2), and arm 25 was ready to be displaced generally horizontally in the direction of arrow A and downwardly in the direction of arrow C to bring tip 15 of finger 14 into contact with sheet 13 to secure stack 24 by pressing sheet 13 downwardly in the direction of arrow J. In FIG. 2, arm 25 has been displaced in this manner in the direction of arrows A and C and tip 15 is contacting and downwardly pressing against the top sheet 13 in stack 24. Arm 25 is moved into the position shown in FIG. 2 prior to sheet 12 being delivered over surface 21 by belt 17. When sheet 12 is delivered, it slides over the top of sheet 13 and over tip 15 until the leading edge 26 contacts and is stopped by paper stop 18. Tip 15 clamps sheet 13 (and the sheets beneath sheet 13) and prevents sheet 12 from frictionally moving sheet 13 out of registration with the sheets beneath sheet 13 when sheet 12 slides over sheet 13 toward stop 18. Since paper stop 18 is offset forwardly from paper stop 19, the stack of paper which is formed by sheets contacting stop 18 is offset forwardly from the stack of paper 24 which was formed by sheets which slid against and contacted stop 19.

After sheet 12 reaches the position shown in FIG. 2, arm 25 is displaced in the direction of arrow B to remove tip 15 from contact with sheet 13. Arm 25 is then displaced upwardly a short distance in the direction of arrow D to a storage or waiting position. After three more sheets have been deposited on two of sheet 12 to complete formation of the second stack of sheets, paper stop 18 is moved upwardly in the direction of arrow E to a storage position in which the elevation of stop 18 is comparable to the elevation of stop 19 in FIGS. 1 and 2, paper stop 19 is moved downwardly to a position in which the elevation of stop 19 is comparable to the elevation of stop 19 in FIGS. 1 and 2, and arm 25 is moved in the direction of arrows A and C such that tip 15 presses downwardly against the top sheet in the stack of registered sheets including sheet 12. Table 16 moves downwardly a short distance in the direction of arrow J. Belt 17 then delivers four more sheets against stop 19 to form yet another offset stack of sheets. And so on.

As would be appreciated by those of skill in the art, during operation of the apparatus of FIGS. 1 and 2, stop 18 can remain fixed in the position shown in FIGS. 1 and 2 while stop 19 is moved between the stored operative position shown in FIGS. 1 and 2 and a deployed operative position in which stop 19 is at an elevation comparable to that of stop 18 and is positioned closer to belt 17 than stop 18.

Any of a variety of motors, gears, cams, shafts, sensors, or other mechanical, electrical, electronic, optical, and/or microprocessor components can be utilized by those of ordinary skill in the art to displace or operate automatically or manually in synchronous relationship stops 18 and 19, table 16, arm 25, and belt 17 in the manner described above. Since many designs can be developed for operating or displacing the moving components of FIGS. 1 and 2 in the manner described, such designs are not set forth herein.

Having described my invention in such terms as to enable those of skill in the art to make and practice it, and having described the presently preferred embodiments thereof,

I claim:

1. Apparatus for stacking sheets in offset stacks, including (a) delivery means for delivering individual sheets;

(b) a support surface;

(c) first paper stop means to stop the movement of sheets delivered by said delivery means, said first paper stop means moveable between at least two operative positions, (i) a first storage position, and (ii) a second deployed position for stopping sheets delivered by said delivery means to form a first stack of sheets on said support surface, said first stack of sheets having a forward portion adjacent said first paper stop means;

(d) second paper stop means to stop the movement of sheets delivered by said delivery means, said second paper stop having a deployed position for stopping sheets delivered by said delivery means to form a second stack of sheets on said support surface above and offset from said first stack of sheets; and, (e) means for clamping securing said forward portion when a sheet in said second stack frictionally slides over and contacts a sheet in said first stack.

2. A method for stacking sheets, comprising the steps of (a) forming a first stack of sheets adjacent first paper stop means, said first stack including a forward portion adjacent said first paper stop means;

(b)clamping said forward portion of said first stack; and, (c) sliding a sheet in a second stack over said first stack.

* * * * *